United States Patent [19]

Murasaki

[11] Patent Number: 4,706,715

[45] Date of Patent: Nov. 17, 1987

[54] MANDREL FOR USE WITH LOOM FOR FORMING LOOPS OF SURFACE-TYPE FASTENERS

[75] Inventor: Ryuichi Murasaki, Toyama, Japan

[73] Assignee: Yoshida Kogyo, K. K., Tokyo, Japan

[21] Appl. No.: 935,035

[22] Filed: Nov. 26, 1986

[30] Foreign Application Priority Data

Dec. 5, 1985 [JP] Japan ..... 60-187698[U]

[51] Int. Cl.[4] ..... D03D 39/20

[52] U.S. Cl. ..... 139/46; 139/47; 139/291 R

[58] Field of Search ..... 139/46, 47, 291 R, 291 C; 26/9

[56] References Cited

U.S. PATENT DOCUMENTS 2,075,187 3/1937 Fligg ..... 139/47

3,083,737 4/1963 Mestral ..... 139/46

FOREIGN PATENT DOCUMENTS 1497183 8/1967 France ..... 139/46

*Primary Examiner*—Henry S. Jaudon

*Attorney, Agent, or Firm*—Hill, Van Santen, Steadman & Simpson

[57] ABSTRACT

An improved mandrel for use with a weaving loom for the formation of loops of a looped fabric suitable for use as a surface-type fastener generally known as a loop-and-hook fastener. The mandrel has a generally V-shaped first recess defined in an upper longitudinal edge thereof and adapted to be disposed adjacent to the fell of a foundation fabric while being woven on the loom, for receiving individual loops therein before they are tensioned on a loop-setting portion. Since all the loops are received in the recess irrespective of their initial looping positions, a warp thread forming loops does not interfere with a weft thread forming a part of the foundation fabric and the loops are placed in a desired upstanding position when tensioned on the loop-setting portion. The loop-setting portion has a second recess defined in a lower longitudinal edge of the mandrel and extending along a limited longitudinal part of the loop-setting portion for releasing the tension on the loops to thereby prevent the loops from being deformed or twisted under undue frictional forces applied thereto as they advance along the loop-setting portion.

6 Claims, 7 Drawing Figures

MANDREL FOR USE WITH LOOM FOR FORMING LOOPS OF SURFACE-TYPE FASTENERS

BACKGROUND OF THE INVENTION

1. Field of the Invention

The present invention relates generally to the manufacture of a surface-type fastener having a number of interlocking elements such as loops or hooks projecting from one surface of a woven foundation fabric. More particularly, it relates to a mandrel for use with a loom for the formation of the loops in synchronism with the weaving of the foundation fabric on the loom.

2. Prior Art

U.S. Pat. No. 3,009,235, issued Nov. 21, 1961 discloses, as reillustrated here in FIGS. 6 and 7, a mandrel A used for the formation of loops B on a woven fabric C. The disclosed mandrel includes a loop-forming portion D of reduced section on which the loops B are formed, and a loop-setting portion E of larger section adapted to tension the loop B after their formation for insuring the formation of a firm fabric with the upstanding loops positioned in a uniform manner.

Since the loop-forming portion D of the disclosed mandrel A has a uniform height throughout the length threof, it is not possible to rectify or correct the deviation of a loop-forming warp thread F from its desired course which would occur when the warp thread F is looped successively around the loop-forming portion D due to, for example, the flexibility of or the initial twisting of the warp thread F. Consequently, successive loops B are formed at different positions on the loop-forming portion D and hence they are subjected to random tensioning forces when advanced to the loop-setting portion F. The final loops B set on the loop-setting portion E have different shapes and configurations and are positioned in a non-uniform manner. Due to the above-mentioned deviation, the loop-forming warp thread F is likely to interfere with a foundation weft thread G prior to the latter is interlaced with a series of foundation warp threads H (two being shown) and with the warp thread F. This interference result in a weaving failure and non-uniform loop formation.

A further disadvantage associated with the mandrel A is in that since the loop-setting portion E has a uniform height, the loops B, as they are advanced along such portion E, are subjected to undue frictional forces which would cause deformation or twisting of the loops B.

SUMMARY OF THE INVENTION

It is accordingly a general object of the present invention to provide an improved loop-forming mandrel which can overcome or substantially eliminate the foregoing drawbacks of the known mandrel.

A more specific object of the present invention is to provide a mandrel adapted to be incorporated in a loom and having structural features capable of forming loops of a uniform shape and configuration without obstructing the weaving operation of the loom.

According to the present invention, there is provided an improved for use with a weaving loom for the formation of loops of a looped fabric suitable for use as a surface-type fastener generally known as a loop-and-hook fastener. The mandrel has a generally V-shaped first recess defined in an upper longitudinal edge thereof and adapted to be disposed adjacent to the fell of a foundation fabric while being woven on the loom, for receiving individual loops therein before they are tensioned on a loop-setting portion. Since all the loops are received in the recess irrespective of their initial looping positions, a warp thread forming loops does not interfere with a weft thread forming a part of the foundation fabric and the loops are placed in a desired upstanding position when tensioned on the loop-setting portion. The loop-setting portion has a second recess defined in a lower longitudinal edge of the mandrel and extending along a limited longitudinal part of the loop-setting portion for releasing the tension on the loops to thereby prevent the loops from being deformed or twised under undue frictional forces applied thereto as they advance along the loop-setting portion.

Many other advantages and features of the present invention will become manifest to those versed in the art upon making reference to the detailed description and the accompanying sheets of drawings in which a preferred structural embodiments incorporating the principles of the present invention is shown by way of illustrative example.

DETAILED DESCRIPTION

Figure 1:
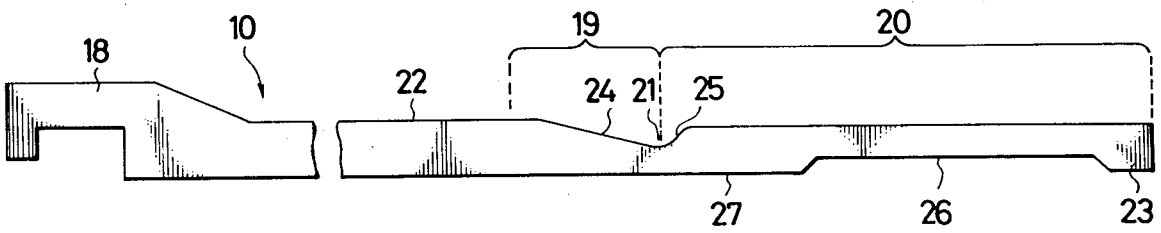
FIG. 1 is a side elevational view of a mandrel embodying the present invention.

The principles of the present invention are particularly useful when embodied in a mandrel, generally denoted by the reference numeral 10 in FIG. 1, for the formation of loops of a looped fabric which is suitable for use as a surface-type fastener member having number of interlocking elements such as loops or hooks projecting from a foundation fabric.

In practice, a number of such mandrels 10 are incorporated in a loom 11 (FIG. 2), however, only one mandrel 10 is shown and described here for clarity.

The loom 11 is of the general type employed in weaving a velvet ribbon and is constructed to produce a foundation fabric 12 by interlacing a series of warp threads 13 with a weft thread 14 progressively at a fell 15. The mandrel 10 is disposed between a selected pair of the warp threads 13 and extends parallel to the warp threads 13 perpendicularly across the fell 15 of the foundation fabric 12 while being woven. Loops 16 on the foundation fabric 12 are formed in a supplementary warp thread 17 passed over the mandrel 10 and woven into the foundation fabric 12 as the latter is woven on the loom 11. The supplementary warp thread 17 preferably is made of thermoplastic synthetic resin, such as nylon or other material capable of being heat-set into a predetermined form, so that the warp thread 17 is capable of retaining, by a heat treatment, the shape which has been imparted thereto during weaving.

As shown in FIG. 1, the mandrel 10 comprises an elongate bar preferably press-formed from a thin steel blade and surface-treated by plating to provide a smooth external surface so as not to damage the warp thread 17 as the latter is formed into the loops 16 around the mandrel 10. The mandrel or elongate bar 10 has at one of its ends a hook 18 enabling it to be hooked on the weaving loom. The mandrel 10 further includes a loop-forming portion 19 on which the loops 16 are formed, and a loop-setting portion 20 adapted to tension the loops 16 after their formation. The two portions 19, 20 are separated by a generally V-shaped first recess 21 defined in an upper longitudinal edge 22 of the mandrel 10, the loop-setting portion 20 extending between the recess 21 and the other end 23 of the mandrel 10. The loop-forming portion 19 has a first guide surface 24 extending along the upper longitudinal edge 22 and sloping downwardly toward the loop-setting portion 20. The loop-setting portion 20 has a second guide surface 25 extending contiguously from a lower end of the first guide surface 24 and sloping upwardly away from the loop-forming portion 20 so as to define the recess 21 jointly with the first guide surface 24. The first guide surface 24 extends substantially throughout the length of the loop-forming portion 19 and has an angle of inclination smaller than that of the second guide surface 25.

The mandrel 10 further has an elongate second recess 26 defined in a lower longitudinal edge 27 of the mandrel 10 and extending along the loop-setting portion 20 through a limited longitudinal part thereof which is intermediate the first recess 21 and the other end 23 of the mandrel 10. The second recess 26 is disposed closer to the other end 23 than to the first recess 21 for a purpose described below.

Figure 2:
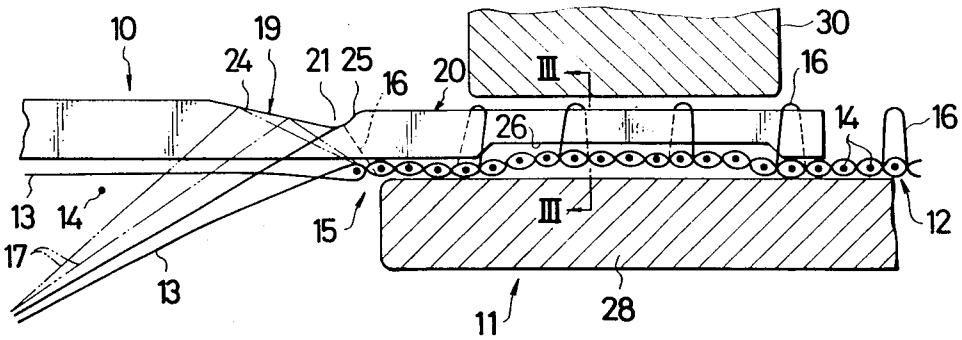
FIG. 2 is a schematic view of a loom in which the mandrel of FIG. 1 is incorporated, the view illustrating the manner in which successive loops are formed on the mandrel the weaving a foundation fabric advances.

The operation of the mandrel 10 in the loom 11 is illustrated in FIG. 2 in which are shown the foundation fabric 12 woven of the warp threads 13 and the weft thread 14, and the mandrel 10 extending closely over the foundation fabric 12 with the first recess 24 disposed adjacent to, and more particularly, immediately upstream of the fell 15 of the foundation fabric 12 while being woven. The foundation fabric 12 moves progressively across a support plate 28 in a direction from the left to the right in the same figure, as the weaving proceeds. During that time, the loops 16 slide along the mandrel 10 progressively engaging the loop-forming portion 19 and the loop-setting portion 20. The supplementary warp thread 17 which forms the loops 16 is directed first to one side and then to the other side of the mandrel 10 to assume a zig-zag or meandering formation.

When the supplementary warp thread 17 is looped around the loop-forming portion 19 to form a loop 16 thereon, the warp thread 17 slides downwardly along the first guide surface 24 into the bottom of the first recess 21. This guided sliding movement of the warp thread 17 is always attained even though the warp thread 17 is likely to deviate from its predetermined course as indicated by phantom lines shown in FIG. 2, due to its own flexibility or the initial twisting or torque given thereto. Thus, the loops 16 are formed at a fixed position on the loop-forming portion 19, i.e. the bottom of the recess 21 as the foundation fabric 12 advances rightwards in the same figure. As indicated by the solid line shown in FIG. 2, the warp thread 17 is retained in the bottom of the recess 21 disposed adjacent to the fell 15, so that this thread 17 does not interfere with the weft thread 14 which has been inserted in a shed between the separated warp threads 13, 13.

Figure 4:
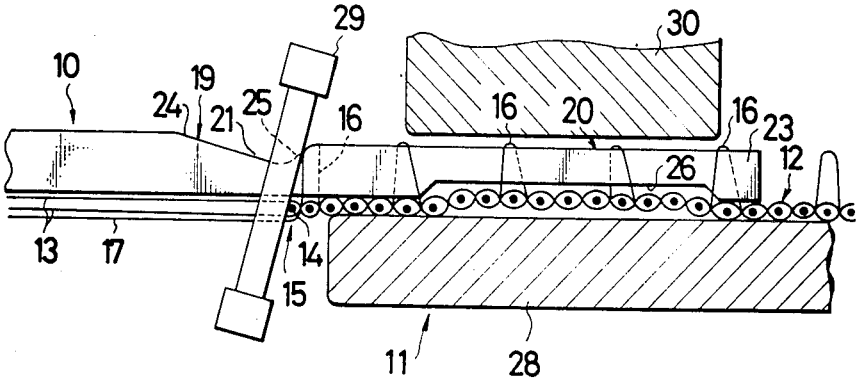
FIG. 4 is a view similar to FIG. 2, but showing a different operation mode of the loom.

Then the weft thread 14 is beated against the fell 15 by a reed 29, as shown in FIG. 4, whereupon one of the loops 16 slides up the second guide surface 25 and on to the loop-setting portion 20 during which time the loop 16 is tensioned. As described above, all the loops 16, which have been formed on the loop-forming portion 19, are guided to a fixed position or the bottom of the recess 21 before their tensioning with the result that uniform tensioning of the individual loops 16 is effected on the loop-setting portion 20. The loops 16 thus tensioned uniformly have a uniform shape and configuration. Although not shown, all the mandrels 10 are disposed in the loom 11 with their recesses 21 held in lateral alignment with one another, such uniform tensioning of all the loops 16 on the loop-setting portions 20 of the respective mandrels 10 ensures that the formation of a firm foundation fabric 12 with the upstanding loops 16 positioned in a uniform manner.

Figure 3:
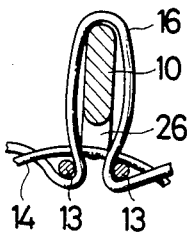
FIG. 3 is an enlarged cross-sectional view taken along line III—III of FIG. 2.

The loops 16 are preferably heat set by means of a heater 30 while they are remain on the loop-setting portion 20 of the mandrel 10. The heater 30 is disposed above the mandrel 10 and extends over the loop-setting portion 20 so that the loops 16 are subjected to a heating treatment after they have been tensioned to assume a desired upstanding form. After the heat treatment has proceeded to some extent, the loops 16 is then advanced along the recessed longitudinal part 26 during which time they are released from tensioning forces. The recess 26 thus provided enables the the loops 16 to pass smoothly through the loop-setting portion while keeping the defired form as shown in FIG. 3, without causing deformation or twisting thereof. If the loop-setting portion 20 were constructed to have a uniform height, the loops 16 would be deformed or twisted due to undue frictional forces generated between the loop-setting portion 20 and the tensioned loops 16 as the loops 16 advance along the loop-setting portion 20.

Figure 5:
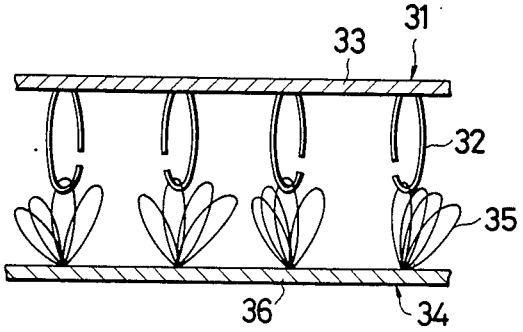
FIG. 5 is a schematic fragmentary coss-sectional view showing a looped fastener member and a hooked fastener member jointed together to form a surface-type fastener manufactured by the loom shown in FIG. 2.
Figure 6:
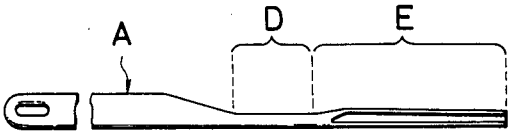
FIG. 6 PRIOR ART
FIG. 6 is a schematic side elevational view of a known mandrel.
Figure 7:
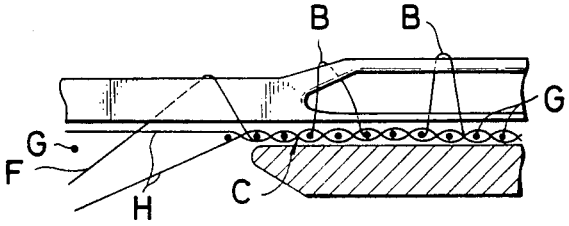
FIG. 7 PRIOR ART
FIG. 7 is an enlarged fragmentary side elevational view of a loom in which the mandrel of FIG. 6 is incorporated, the view illustrating the operation of the loom.

The mandrel 10 of the present invention can be employed both in the formation of a hooked fabric fastener member 31 and in the formation of a looped fabric fastener member 34, as shown in FIG. 5. To form the hooked fabric fastener member 31, the supplementary warp thread 17 forming loops 16 is preferably made of a thermoplastic monofilament capable of heat-setting as described above. After heat-setting, the loops 16 of monofilament are cut to form hooks 32 projecting from a woven foundation fabric 33. In case the looped fabric fastener member 34 is to be produced, the warp thread 17 is preferably made of a multifilament so that when subjected to a known brushing treatment, each parent loop of multifilament produce a plurality of loop elements 35 projecting from a foundation fabric 36.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A mandrel for use with a loom for the formation of loops projecting from a foundation fabric as the latter is woven on the loom, said mandrel comprising:

an elongate bar for being disposed closely over one surface of a foundation fabric while being woven and extending perpendicular across a fell of the foundation fabric, said elongate bar including a longitudinal loop-forming portion adapted to be disposed substantially upstream of the fell for supporting thereon the loops during their formation, a longitudinal loop-setting portion contiguous to said loop-forming portion and adapted to be disposed substantially downstream of the fell for tensioning the loops after their formation to set the latter in upstanding positions, a generally V-shaped first recess defined in an upper longitudinal edge of said elongate bar and extending in and between said loop-forming portion and said loop-setting portion for receiving therein the loops before their formation, and an elongate second recess defined in a lower longitudinal edge of said elongate bar and extending along a limited longitudinal part of said loop-setting portion for releasing a tension on the loops.

2. An apparatus according to claim 1, said first recess being disposed immediately upstream of the fell.

3. A mandrel according to claim 1, said loop-forming portion having a first guide surface extending along said upper longitudinal edge of said elongate bar and sloping downwardly toward the fell, said loop-setting portion having a second guide surface extending contiguously from said first guide surface and sloping upwardly away from the fell, said first and second guide surfaces jointly defining therebetween said first recess.

4. A mandrel according to claim 3, said first guide surface extending substantially along the entire length of said loop-forming portion.

5. A mandrel according to claim 3, said first guide surface having an angle of inclination which is smaller than that of said second guide surface.

6. A mandrel according to claim 1, said elongate bar having one end adapted to be conncted to the loom, said loop-setting portion extending between said first recess and the other end of said elongate bar, said second recess being disposed closer to said other end of said elongate bar than to said first recess.

* * * * *